US008590749B2

(12) United States Patent
Beranger et al.

(10) Patent No.: US 8,590,749 B2
(45) Date of Patent: Nov. 26, 2013

(54) ATTACHMENT DEVICE FOR ATTACHING A PUMP ONTO A TANK NECK

(75) Inventors: Stephane Beranger, Surtauville (FR); Florent Pouliaude, Fouqueville (FR)

(73) Assignee: Aptar France SAS, Le Neubourg (FR)

( * ) Notice: Subject to any disclaimer, the term of this patent is extended or adjusted under 35 U.S.C. 154(b) by 94 days.

(21) Appl. No.: 13/319,011

(22) PCT Filed: Mar. 3, 2010

(86) PCT No.: PCT/FR2010/050835

§ 371 (c)(1),
(2), (4) Date: Nov. 4, 2011

(87) PCT Pub. No.: WO2010/128237

PCT Pub. Date: Nov. 11, 2010

(65) Prior Publication Data

US 2012/0061422 A1 Mar. 15, 2012

(30) Foreign Application Priority Data

May 6, 2009 (FR) ..... 09 53018

(51) Int. Cl.
*B67B 1/00* (2006.01)

(52) U.S. Cl.
USPC ..... 222/153.09; 222/153.11; 222/320

(58) Field of Classification Search
USPC ..... 215/274, 275; 220/319; 222/153.01, 222/153.09, 153.11, 320–321.9, 222/402.1–402.25, 570
See application file for complete search history.

(56) References Cited

U.S. PATENT DOCUMENTS

| | | | | |
|---|---|---|---|---|
| 5,562,219 | A | 10/1996 | de Pous et al. | |
| 6,253,941 | B1 | 7/2001 | VanBrocklin et al. | |
| 6,575,339 | B2 * | 6/2003 | Jourdin et al. | 222/321.7 |
| 7,451,889 | B2 * | 11/2008 | Mantis | 220/530 |
| 2001/0048003 | A1 * | 12/2001 | Jourdin et al. | 222/321.7 |
| 2004/0035887 | A1 * | 2/2004 | Beranger et al. | 222/321.9 |
| 2006/0273115 | A1 * | 12/2006 | De Pous | 222/321.9 |
| 2008/0164286 | A1 * | 7/2008 | Garcia et al. | 222/321.7 |

FOREIGN PATENT DOCUMENTS

EP 0 704 251 A2 4/1996

OTHER PUBLICATIONS

International Preliminary Report issued Nov. 9, 2011 for counterpart application No. PCT/FR2010/050835.

* cited by examiner

*Primary Examiner* — Kevin P Shaver
*Assistant Examiner* — Patrick M Buechner
(74) *Attorney, Agent, or Firm* — Sughrue Mion, PLLC

(57) ABSTRACT

A fastener device for fastening a dispenser member on a neck of a reservoir, the device including a fastener ring. The fastener ring having reception mechanism for receiving, in stationary manner, the dispenser member; an annular plate for exerting axial pressure on the neck; and a fastener skirt that extends downwards from the plate, the skirt including a fastener mechanism for fastening around the neck. The ring is made of two different plastics materials, a substantially-hard first material and a flexible second material that is more flexible than the first material. The device also includes a hoop that, in the final assembled position, extends around the skirt of the ring with radial clamping. The flexible second material comes into contact with the hoop.

12 Claims, 2 Drawing Sheets

ATTACHMENT DEVICE FOR ATTACHING A PUMP ONTO A TANK NECK

CROSS REFERENCE TO RELATED APPLICATIONS

Figure 1:
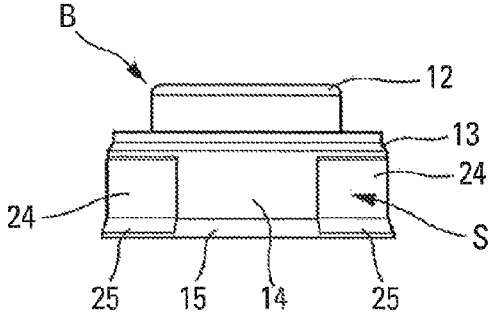
Figure 3:
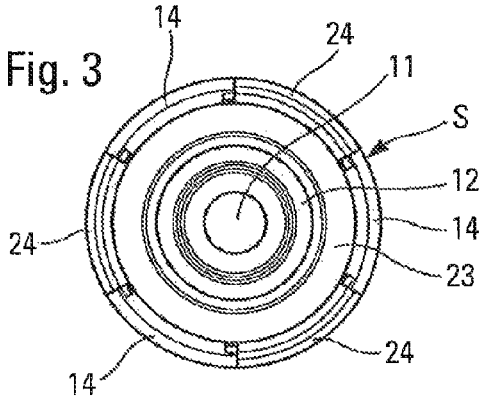
Figure 2:
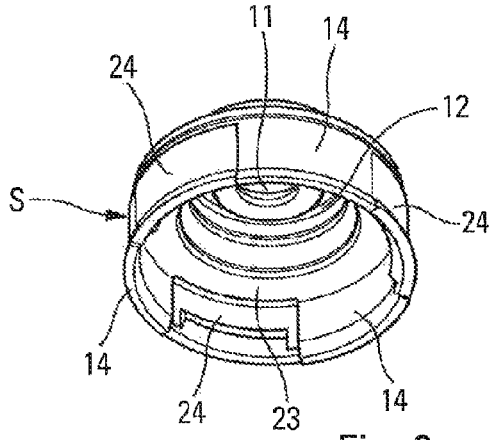
Figure 4:
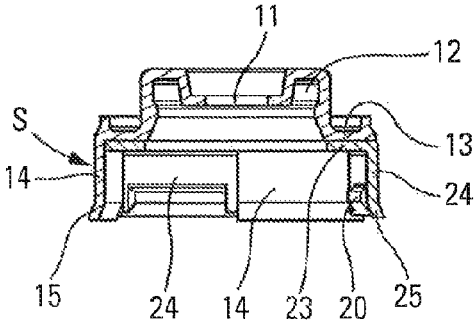

This application is a National Stage of International Application No. PCT/FR2010/050835 filed May 3, 2010, claiming priority based on French Patent Application No. 09 53018 filed May 6, 2009, the contents of all of which are incorporated herein by reference in their entirety.

The present invention relates to a fastener device for fastening a dispenser member, such as a pump or a valve, on the neck of a reservoir. This type of fastener device is frequently used to fasten pumps or valves on reservoirs in the fields of perfumery, cosmetics, or even pharmacy. Other technical fields may also use such fastener devices.

A particular type of fastener device uses a fastener ring and a hoop that, in the final assembled position, extends around the ring with radial clamping. The fastener ring comprises: reception means for receiving, in stationary manner, the pump or the valve; an annular plate for exerting axial pressure on the neck of the reservoir; and a fastener skirt that extends downwards from the plate, the skirt including fastener means for fastening around the reservoir neck.

In some configurations, the function of the hoop is to block the fastener means of the ring around the neck of the reservoir. Blocking is performed by preventing the ring from deforming outwards. In other configurations, the hoop has only an appearance function, masking the fastener ring in full or in part.

Either way, it is necessary for the hoop to grip on the ring securely. The lack of grip between the hoop and the ring is a recurring problem in this type of hoop-and-ring fastener device, and numerous prior-art solutions have already been proposed in order to mitigate it. Generally, attempts have been made to provide fastener profiles for the inside wall of the hoop in the form of recessed or projecting profiles. Given that the fastener ring is very generally made of plastics material and the hoop is made of metal, the plastic-creep qualities of the fastener ring are used so as to creep around and/or into the profiles that are formed on/in the inside wall of the hoop. In the'prior art, documents EP 0 704 251 and U.S. Pat. No. 6,253,941 propose such solutions.

However, the solutions that use hoop profiles require special machining of the hoop that considerably increases its cost.

An object of the present invention is to overcome the above-mentioned drawbacks of the prior art by defining a fastener device having a hoop that is extremely simple, and having a ring that is made of well-known conventional molding techniques. In the invention, the ring is made of two different plastics materials, namely a substantially-hard first material, and a flexible second material that is more flexible than the first material. Advantageously, the flexible second material comes into contact with the hoop. Thus, the flexible deformation characteristics of the flexible second material are used to increase the quality of the contact between the ring and the hoop. The flexible second material deforms more easily and thus comes into intimate contact with the hoop over an extensive surface area, and this increases the radial clamping considerably, thereby making it possible for the hoop to grip the ring securely. In addition, the hard or rigid characteristics of the substantially-hard first material are used to receive the pump or the valve in stationary and secure manner in the reception means, and to fasten the fastener means in secure manner on the neck of the reservoir. Consequently, the dual-material fastener ring offers both the advantages of the hard material for receiving the pump or valve and for fastening on the neck, and the advantages of the flexible material for keeping the hoop gripped on the ring. It is possible for the hoop to come into contact only with the flexible second material. In a variant, the hard first material may also come into contact with the hoop.

In a first advantageous embodiment of the invention, the skirt includes a plurality of hard-material segments that are made of the substantially-hard first material, and a plurality of flexible-material segments that are made of the flexible second material, the segments being interposed in such a manner as to form a continuous skirt. Preferably, the segments extend axially downwards from the plate. Thus, the hard and flexible segments are arranged in alternating and continuous manner, such that the two hard segments surrounding a flexible segment deform the flexible segment by compressing it while the hoop is being force-fitted on the skirt. The deformation of the flexible segments results in them being deformed radially outwards to press against the inside wall of the hoop. The hard segments and thus used to stress the flexible segments tangentially, and to urge them against the hoop.

In a practical embodiment, the ring comprises: a main body that is made of the substantially-hard first material; and a secondary body that is made of the flexible second material; the main body forming the reception means, the plate, and hard-material segments; the secondary body forming flexible-material segments that are each arranged between two hard-material segments.

In another embodiment of the invention, the skirt is made mainly with the substantially-hard first material and also includes an outer coating that is made of the flexible second material, the outer coating coming into contact with the hoop. Advantageously, the ring includes a bushing that extends upwards from the plate, the bushing is mainly made of the substantially-hard first material and also includes an outer coating that is made of the flexible second material, the outer coating coming into contact with the hoop. In this configuration, the outer coating is deformed by radial compression between the hard material and the hoop. By way of example, it is possible to envisage that the hard-material segments are coated in part with flexible material. It is also possible to envisage a continuous skirt made of hard material that is coated in full or in part with flexible material.

According to a characteristic that is common to all of the embodiments, the plate may be made of the rigid first material and also includes a neck gasket that is made of the flexible second material.

In a very practical embodiment, the ring may be constituted by a one-piece main body that is made of substantially-hard material, and by a one-piece secondary body that is made of flexible material, the secondary body advantageously being overmolded onto the main body. The fastener ring may thus be made without additional difficulty other than the difficulty associated with the technique of overmolding or of bi-injection.

According to another advantageous characteristic of the invention, the neck gasket connects the flexible-material segments together as a single piece. Advantageously, the neck gasket and the outer coating are connected together via at least one bridge that passes through the skirt or the bushing. Thus, all of the flexible material forms a single piece, such that the mold needs only a single injection point.

In another advantageous aspect of the invention, the skirt includes a free bottom end that initially flares outwards before the hoop is assembled on the ring. When the free bottom end of the skirt is made both of hard material and of flexible material in alternating manner, the inward radial deformation of the free end by the hoop causes the hard segments to deform inwards, thereby reducing the space for the flexible segments that are thus caused to press very strongly against the inside wall of the hoop, thereby improving still further the grip of the hoop on the ring.

The spirit of the invention is to concentrate, in the ring, all of the qualities necessary for receiving the pump or valve, for fastening on the neck, and for keeping the hoop gripped on the ring, by acting on the intrinsic qualities of different component materials. For snap-fastening and/or anchoring, the qualities of the hard material are used, and for radial clamping and friction, the qualities of the flexible material are used.

The invention is described more fully below with reference to the accompanying drawings which show two embodiments of the invention by way of non-limiting example.

Figure 5:
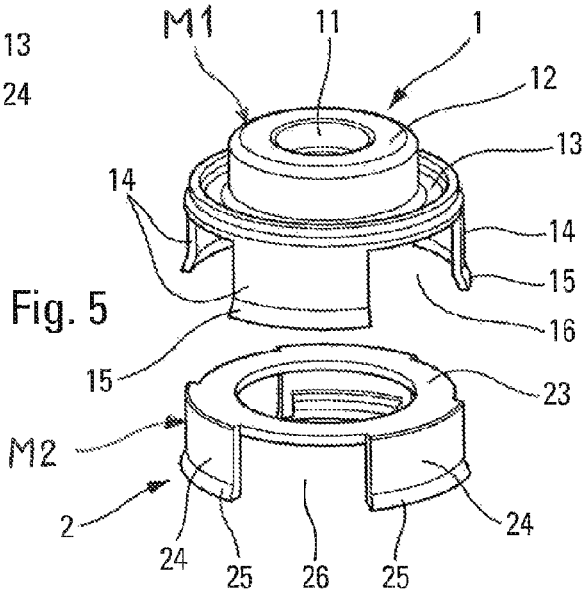
Figure 7:
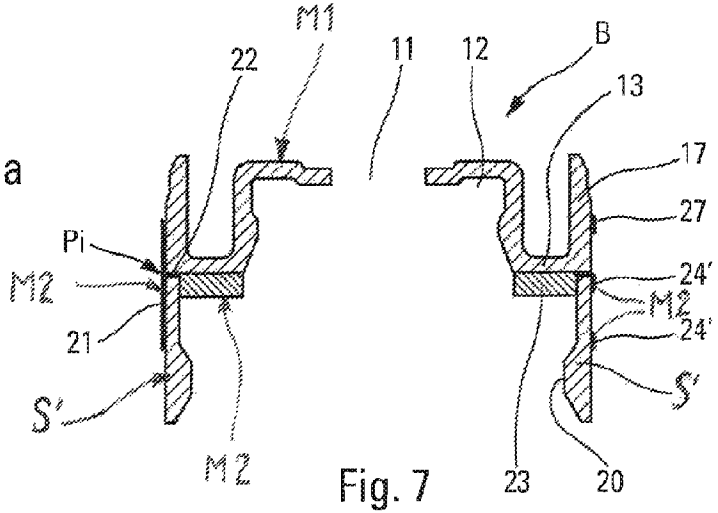
Figure 6A:
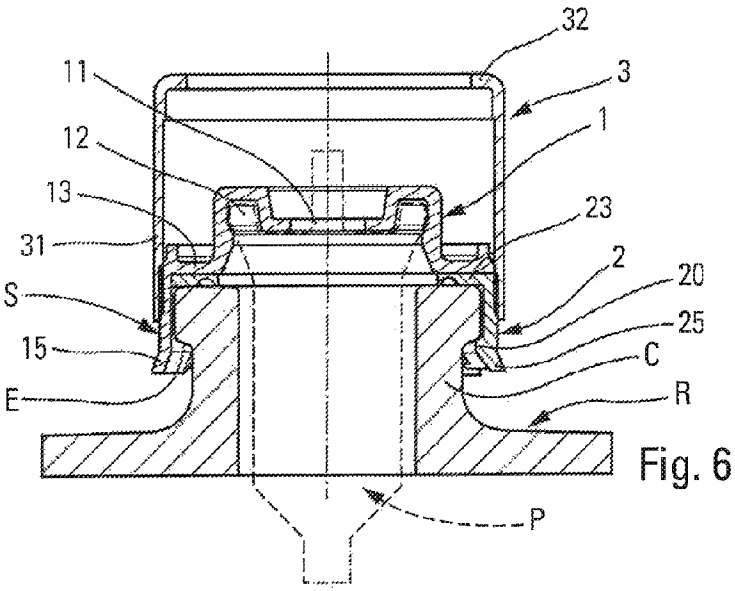
Figure 6B:
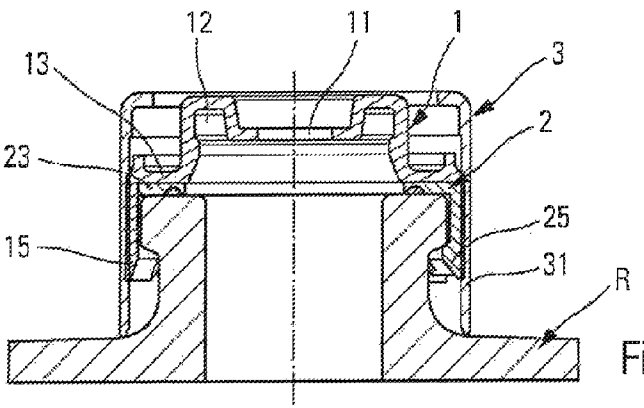

In the figures:

FIGS. 1 to 5 are various views showing a fastener ring in a first embodiment of the invention;

FIGS. 6*a* and 6*b* are vertical-section views through the fastener ring in FIGS. 1 to 5, respectively during assembly and in the final assembled position on a reservoir neck; and FIG. 7 is a vertical-section view through a fastener ring in a second embodiment of the invention.

Reference is made firstly to FIGS. 1 to 6*b* in order to describe in detail the structure and the functions of the fastener ring in a first embodiment of the invention. In conventional manner, the ring B includes reception means 12 for receiving, e.g. by snap-fastening, a dispenser member P, such as a pump or a valve. By way of example, the dispenser member P includes a snap-fastener collar having a shape that is adapted to the shape of the reception means 12. The reception means 12 also define a central through hole 11 for the actuator rod of the pump or valve. The reception means 12 are extended over the outer periphery by a radial plate 13 that is for arranging on the top edge of the neck C of the reservoir R. The plate 13 has a general configuration in the shape of a disk. The plate is connected at its outer periphery to a substantially cylindrical skirt S that extends downwards from the plate. The skirt S presents an inside diameter that is adapted to the diameter of the neck C of the reservoir R, in such a manner that the skirt can be mounted around the neck C. The skirt includes fastener means 20 that are in the form of inwardly-projecting profiles for coming into engagement below a shoulder E that is formed by the neck C. In this first embodiment, the fastener means 20 are arranged in the proximity of the free bottom end of the skirt. It should also be observed that the free end flares outwards in the initial state. This is shown in FIG. 6*a*. The flaring bottom end is situated on the axial path of the hoop 3 so that the hoop deforms the flaring free end inwards in such a manner as to push the fastener means 20 below the shoulder E. This is visible in FIG. 6*b*. This design is entirely conventional for a fastener device that uses a fastener ring and a hoop.

As visible in FIGS. 6*a* and 6*b*, the hoop 3 presents a general configuration that is substantially cylindrical, with a main cylindrical section 31 that is extended at its top end by an inwardly-directed annular rim 32. Advantageously, the inside wall of the cylindrical section 31 is smooth, i.e. it does not have fastener profiles. The hoop 3 is force-fitted around the skirt S of the ring B. The hoop is moved between an intermediate assembly position shown in FIG. 6*a*, and a final assembled position shown in FIG. 6*b*. In FIG. 6*a*, the hoop is not yet engaged around the fastener means 20, unlike in FIG. 6*b*. It can also be seen that the hoop causes the free bottom end of the skirt S to deform, and as a result causes the fastener means 20 to be engaged permanently below the shoulder E of the neck C.

The fastener ring B is made of plastics material using the injection-molding technique. In the invention, the ring B is made of two different plastics materials, namely a substantially-hard first material M1, and a flexible second material M2 that is more flexible than the first material M1. Thus, the two materials differ mainly in their hardness or flexibility. According to a characteristic of the invention, the flexible second material M2 is for coming into contact with the hoop 3 in such a manner as to generate intimate contact that increases friction, and consequently radial clamping. Finally, the grip of the hoop on the ring is considerably improved. The contact between the hoop and the ring may be provided entirely by the flexible second material M2. In a variant, the first material M1 may also come into contact with the hoop.

In this first embodiment, the flexible second material M2 forms three flexible-material segments 24 that are arranged between three hard-material segments 14. The segments 14, 24 are arranged in alternating manner, forming a skirt that is continuous, i.e. that does not have slots. It can also be said that the slots formed between the hard-material segments 14 are filled in completely by the flexible segments 24. This is visible in FIGS. 1 to 5. The fastener means 20 may be formed by the hard-material segments 14 and/or the flexible-material segments 24. The free bottom end is formed jointly by the ends 15 of the hard-material segments 14 and by the ends 25 of the flexible-material segments 24. In a preferred variant, the flexible segments 24 are shorter than the hard segments 14, such that the free bottom end is notched. The flexible-material segments 24 extend downwards from the plate 13 and are terminated at the same level as the hard-material segments 14. At their top ends, the hard-material segments 14 are connected directly to the plate 13 that is made of the hard first material M1, as are the reception means 12. Advantageously, the plate 13 is provided with a neck gasket 23 that is also made of the flexible second material M2. Advantageously, the neck gasket 23 is made integrally with the flexible-material segments 24, as can be seen in FIG. 5. The ring B is thus made of a main body 1 that is made of the hard first material M1, and a secondary body 2 that is made of the flexible second material M2. The main body 1 forms the reception means 12, the plate 13, and the hard-material segments 14, while the secondary body 2 forms the flexible-material segments 24 and the neck gasket 23. The main body 1 and the secondary body 2 may be made in the form of two separate parts. Preferably, the main body and the secondary body are made as a single part by overmolding or bi-injection. By way of example, it is possible to overmold the secondary body 2 onto the main body 1. Consequently, FIG. 5 is not realistic for a fastener ring made as a single part, but it enables the strategy of the ring to be understood better.

When the ring B is in the position shown in FIG. 6*a*, it is subjected to practically no stress. However, when the hoop 3 is lowered around the ring B, the hoop becomes radially clamped around the skirt S that is made up both of hard material M1 and of flexible material M2. The hard-material segments 14 thus compress the flexible-material segments 24 that respond by deforming outwards to press intimately against the inside wall of the hoop 3. This phenomenon is even greater at the bottom ends 25 of the flexible-material segments 24 that are compressed very strongly by the bottom ends 15 of the hard-material segments 14. The hoop 3 thus grips the skirt S of the ring B securely.

Reference is made below to FIG. 7 that shows a second embodiment of the invention, which embodiment may however be combined with the first embodiment in FIGS. 1 to 6*b*. In this second embodiment, the ring B is made mainly of the substantially-hard first material M1 that forms the reception means 12, the plate 13, the skirt S', and a bushing 17. The ring also includes a neck gasket 23 that is made of the flexible second material M2. The neck gasket is arranged just below the plate 13, inside the skirt S'. In the invention, the flexible second material M2 also forms an outer coating 24' that extends in full or in part over the outside wall of the skirt S'. By way of example, the outer coating 24' may be in the form of a plurality of annular strips that extend around the skirt S'. Advantageously, the bushing 17 may also be provided with an outer coating 27 on its outside wall. The outer coating 27 may have the same configuration as the outer coating 24' of the skirt S'. In order to be able to mold the outer coatings 24' and 27 together, said outer coatings are connected by an injection bar 21 that is situated at the injection point Pi. In addition, the neck gasket 23 may be connected to the bar 21 by one or more bridges of material 22 that pass(es) through the wall thickness of the skirt S' and/or of the bushing 17.

Although not shown, it is possible to envisage the ring of the first embodiment in FIGS. 1 to 6*b* with a bushing 17 provided with an outer coating made of the flexible second material M2. In addition, it is possible to envisage that the hard-material segments 14 are provided in full or in part with an outer coating of the same type as the coating 24' of the skirt S'.

In the first embodiment, the flexible second material M2 that is pressed into contact with the inside wall of the hoop is subjected to tangential compression resulting from the flexible-material segments 24 being arranged between two hard-material segments 14. In the second embodiment in FIG. 7, the flexible material M2 that forms the outer coatings is deformed by radial compression between the hard material M1 and the hoop 3. Either way, the flexible material M2 is pressed strongly with extensive intimate contact against the inside wall of the hoop. The hoop 3 thus grips the fastener ring much better. Grip may be improved still further by providing the inside wall of the hoop with projecting or recessed profiles.

The invention claimed is:

1. A fastener device for fastening a dispenser member, on a neck of a reservoir, the device comprising:

a fastener ring comprising: reception means for receiving, in stationary manner, the dispenser member; an annular plate for exerting axial pressure on the neck; and a fastener skirt that extends downwards from the plate, the skirt including fastener means for fastening around the neck; the ring being made of a rigid first material, and a flexible second material that is more flexible than the first material; and a hoop that, in the final assembled position, extends around the skirt of the ring with radial clamping; and the flexible second material comes into contact with the hoop.

2. A fastener device according to claim 1, wherein the rigid first material comes into contact with the hoop.

3. A fastener device according to claim 1, wherein the skirt includes a plurality of hard-material segments that are made of the rigid first material, and a plurality of flexible-material segments that are made of the flexible second material, the segments being interposed in such a manner as to form a continuous skirt.

4. A fastener device according to claim 3, wherein the segments extend axially downwards from the radial plate.

5. A fastener device according to claim 1, wherein the ring comprises: a main body that is made of the rigid first material; and a secondary body that is made of the flexible second material; the main body forming the reception means, the plate, and hard-material segments; the secondary body forming flexible-material segments that are each arranged between two hard-material segments.

6. A fastener device according to claim 1, wherein the skirt is made mainly with the rigid first material and also includes an outer coating that is made of the flexible second material, the outer coating coming into contact with the hoop.

7. A fastener device according to claim 6, wherein a neck gasket and the outer coating are connected together via at least one bridge that passes through the skirt or the bushing.

8. A fastener device according to claim 1, wherein the ring includes a bushing that extends upwards from the plate, the bushing is mainly made of the rigid first material and also includes an outer coating that is made of the flexible second material, the outer coating coming into contact with the hoop.

9. A fastener device according to claim 1, wherein the plate is made of the rigid first material and also includes a neck gasket that is made of the flexible second material.

10. A fastener device according to claim 9, wherein the neck gasket connects the flexible-material segments together as a single piece.

11. A fastener device according to claim 1, wherein the ring is constituted by a one-piece main body that is made of rigid material, and by a one-piece secondary body that is made of flexible material, the secondary body being overmolded onto the main body.

12. A fastener device according to claim 1, wherein the skirt includes a free bottom end that initially flares outwards before the hoop is assembled on the ring.

* * * * *

UNITED STATES PATENT AND TRADEMARK OFFICE

CERTIFICATE OF CORRECTION

PATENT NO. : 8,590,749 B2
APPLICATION NO. : 13/319011
DATED : November 26, 2013
INVENTOR(S) : Stephane Beranger and Florent Pouliaude It is certified that error appears in the above-identified patent and that said Letters Patent is hereby corrected as shown below:

On the title page, correct the International Application filing date as follows:

PCT Filed ~~March 3, 2010~~

May 3, 2010

Signed and Sealed this
Thirteenth Day of May, 2014

Michelle K. Lee

Michelle K. Lee
*Deputy Director of the United States Patent and Trademark Office*